US007980314B2

(12) United States Patent
Mack

(10) Patent No.: US 7,980,314 B2
(45) Date of Patent: Jul. 19, 2011

(54) GAS RESTRICTOR FOR PUMP

(75) Inventor: John J Mack, Catoosa, OK (US)

(73) Assignee: Baker Hughes Incorporated, Houston, TX (US)

( * ) Notice: Subject to any disclaimer, the term of this patent is extended or adjusted under 35 U.S.C. 154(b) by 85 days.

(21) Appl. No.: 12/254,369

(22) Filed: Oct. 20, 2008

(65) Prior Publication Data

US 2010/0096140 A1 Apr. 22, 2010

(51) Int. Cl.
*E21B 43/38* (2006.01)

(52) U.S. Cl. ..... 166/369; 166/105.5; 166/110

(58) Field of Classification Search ..... 166/369, 166/105, 105.5, 110
See application file for complete search history.

(56) References Cited

U.S. PATENT DOCUMENTS

| | | | | |
|---|---|---|---|---|
| 1,377,762 | A * | 5/1921 | Duhon | 166/105.1 |
| 5,588,486 | A | 12/1996 | Heinrichs | |
| 6,715,556 | B2 | 4/2004 | Mack et al. | |
| 7,270,178 | B2 * | 9/2007 | Selph | 166/105.5 |
| 2010/0065280 | A1 * | 3/2010 | Tetzlaff et al. | 166/373 |

* cited by examiner

*Primary Examiner* — William P Neuder
(74) *Attorney, Agent, or Firm* — Bracewell & Giuliani LLP

(57) ABSTRACT

An inlet apparatus for a well pump.

26 Claims, 14 Drawing Sheets

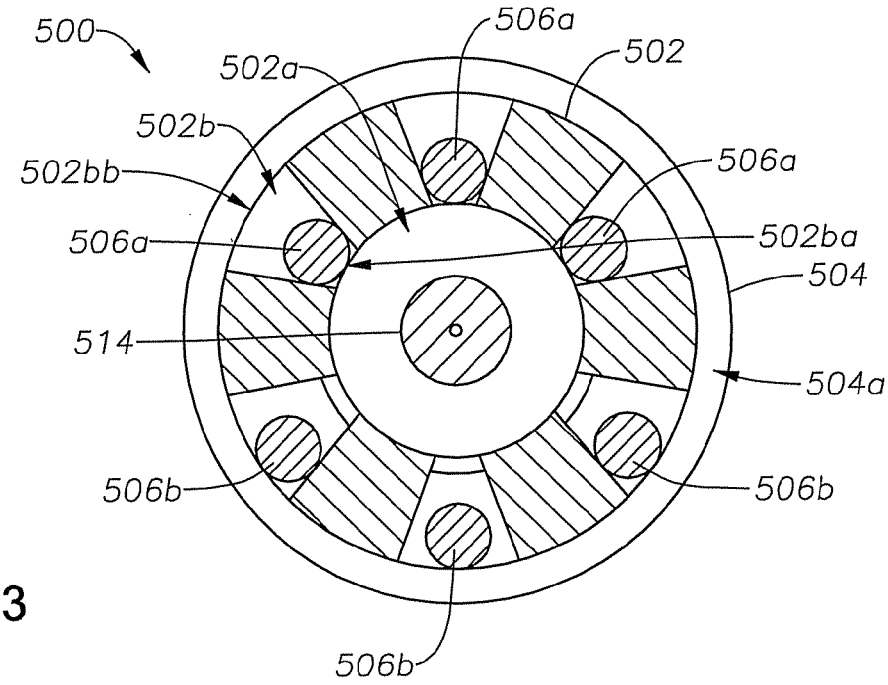
Fig. 13
Fig. 15
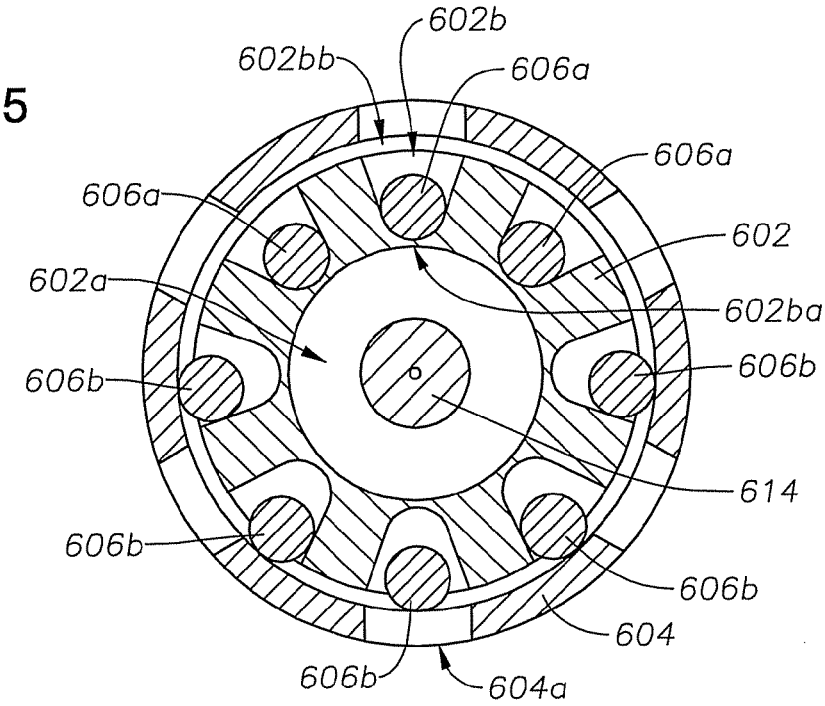

GAS RESTRICTOR FOR PUMP

BACKGROUND

1. Field of Invention

This invention relates in general to well pumps, and in particular to a restictor device that restricts entry of gas into the intake of well pump.

2. Background of the Invention

Submersible well pumps are frequently employed for pumping well fluid from lower pressure oil wells. One type of pump comprises a centrifugal pump that is driven by a submersible electrical motor. The pump has a large number of stages, each stage comprising a diffuser and an impeller. Another type of pump, called progressive cavity pump, rotates a helical rotor within an elastomeric helical stator. In some installations, the motor for driving a progressive cavity pump is an electrical motor assembly attached to a lower end of the pump. centrifugal pumps are normally used for pumping higher volumes of well fluid than progressive cavity pumps.

Both types of pumps become less efficient when-significant amounts of gas from the well fluid flow into the intakes. In a horizontal well, for example, any gas in the well fluid tends to migrate to the upper side of the casing, forming a pocket of free gas. The gas tends to flow into a portion of the intake on the higher side of the pump intake.

Gas restrictors or separators for coupling to the intake of pump, at least in a horizontal well, are known in the prior art. While the prior art types may be workable, improvements are desired, particularly for pumps that pump very viscous crude oil.

SUMMARY OF INVENTION

According to one aspect of the invention, an inlet apparatus for a submersible well pump has been provided that includes a tubular housing for connection to an intake of the pump, the housing having an axis and defining a plurality of circumferentially spaced apart apertures, and a plurality of valve members operably coupled to the housing, each valve member adapted to control a flow of fluidic materials into at least one corresponding aperture.

According to another aspect of the present invention, a method of operating an intake valve for a submersible pump, the valve comprising a plurality of valve elements for controlling the flow of materials into a plurality of inlet passages defined in the valve, has been provided that includes controlling a degree to which materials flow into the inlet passages of the valve by permitting a gravitational force to displace the valve elements relative to the valve.

According to another aspect of the present invention, an apparatus for pumping a well has been provided that includes a pump; the pump having an intake section; a tubular housing for connection to an intake of the pump, the housing having an axis and defining a plurality of circumferentially spaced apart apertures; and a plurality of valve members operably coupled to the housing, each valve member adapted to control a flow of fluidic materials into at least one corresponding aperture; a sealing section coupled to the tubular housing; a motor coupled to the sealing section; and a drive shaft coupled between the motor and the pump and passing through the tubular housing for transmitting torque from the motor to the pump.

According to another aspect of the present invention, a method of operating a submersible pump, having an inlet and an outlet, has been provided that includes positioning the pump within a wellbore casing that traverses a subterranean formation; coupling a conduit to the outlet of the pump; coupling a valve to the inlet of the pump that comprises a plurality of valve elements for controlling the flow of materials into a plurality of inlet passages defined in the valve; coupling a motor to the pump; and controlling a degree to which materials flow into the inlet passages of the valve by permitting a gravitational force to displace the valve elements relative to the valve.

BRIEF DESCRIPTION OF DRAWINGS

Some of the features and benefits of the present invention having been stated, others will become apparent as the description proceeds when taken in conjunction with the accompanying drawings, in which.

Figure 11:
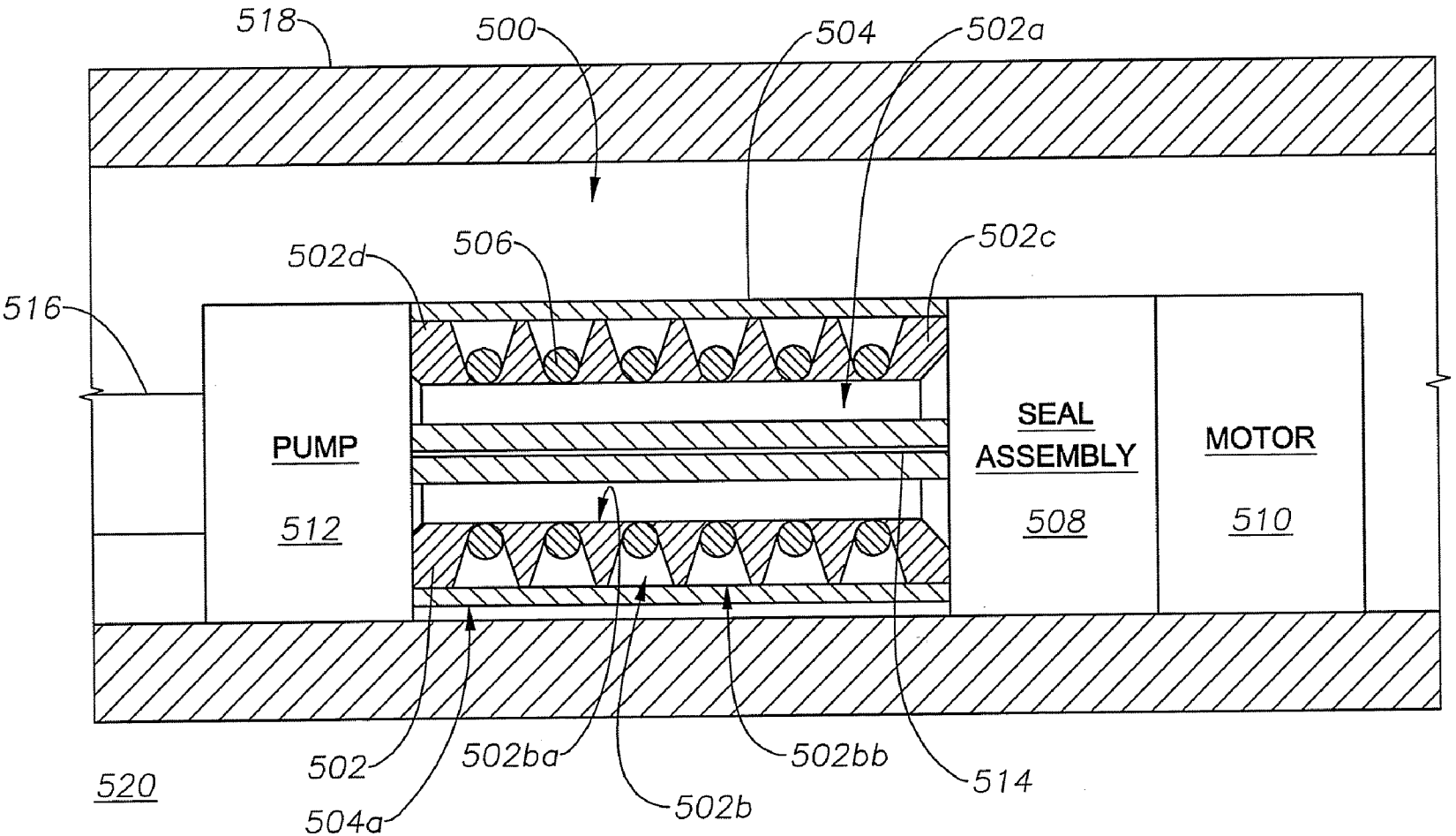
FIG. 11 is a fragmentary cross sectional view of an exemplary embodiment of an intake valve for use with a submersible pump.
Figure 14:
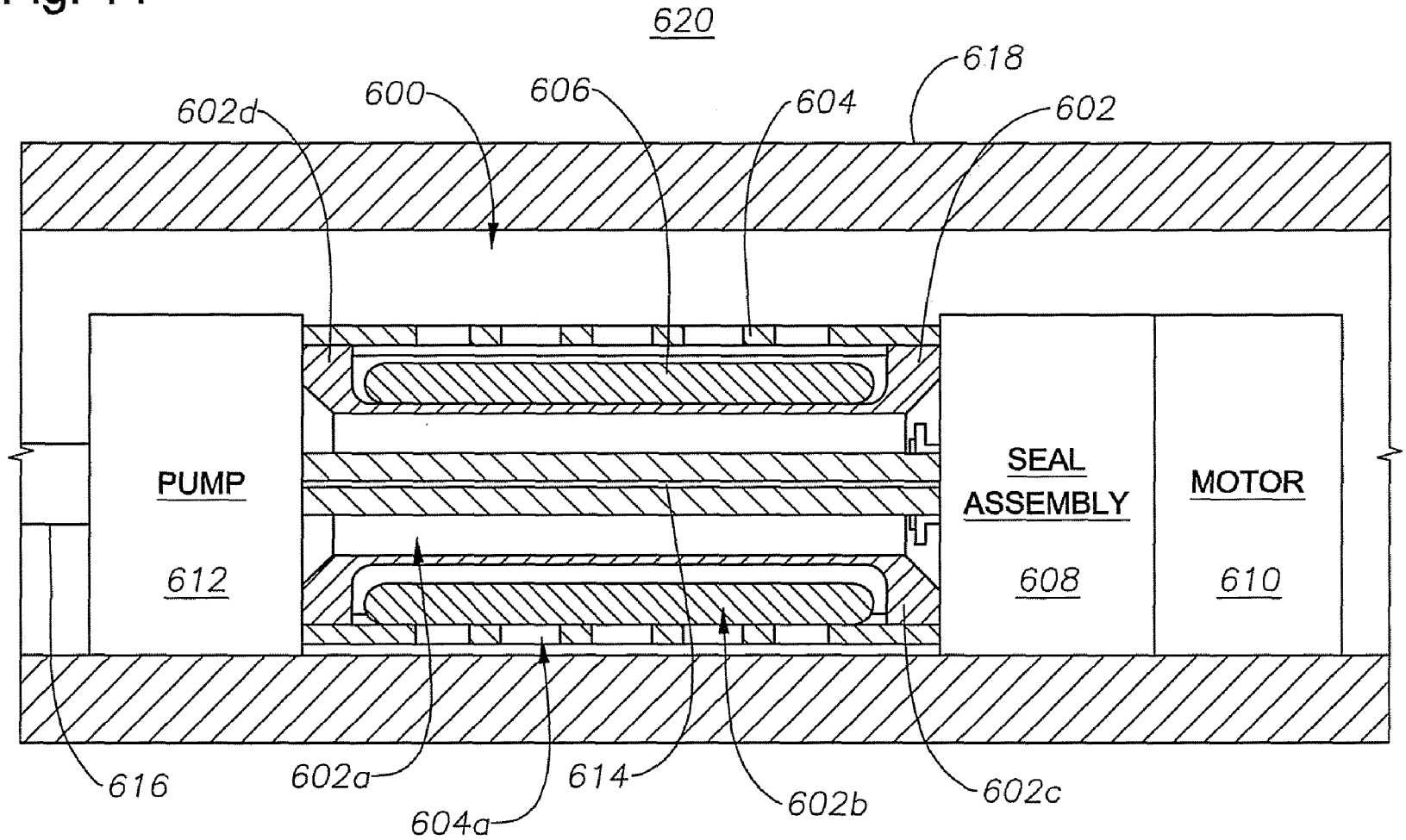

FIG, 13 is cross sectional view of the operation of the intake valve of FIG. 11;

FIG. 14 is a fragmentary cross sectional view of an exemplary embodiment of an intake valve for use with a submersible pump; and FIG. 15 is a perspective view of the operation of the intake valve of FIG. 14.

DETAILED DESCRIPTION OF THE EXEMPLARY EMBODIMENTS

The present invention will now be described more fully hereinafter with reference to the accompanying drawings in which exemplary embodiments of the invention are shown-This invention may, however, be embodied in many different forms and should not be construed as limited to the illustrated embodiments set forth herein; rather, these embodiments are provided so that this disclosure will be through and complete, and will fully convey the scope of the invention to those skilled in the art. Like numbers refer to like elements throughout.

Figure 1:
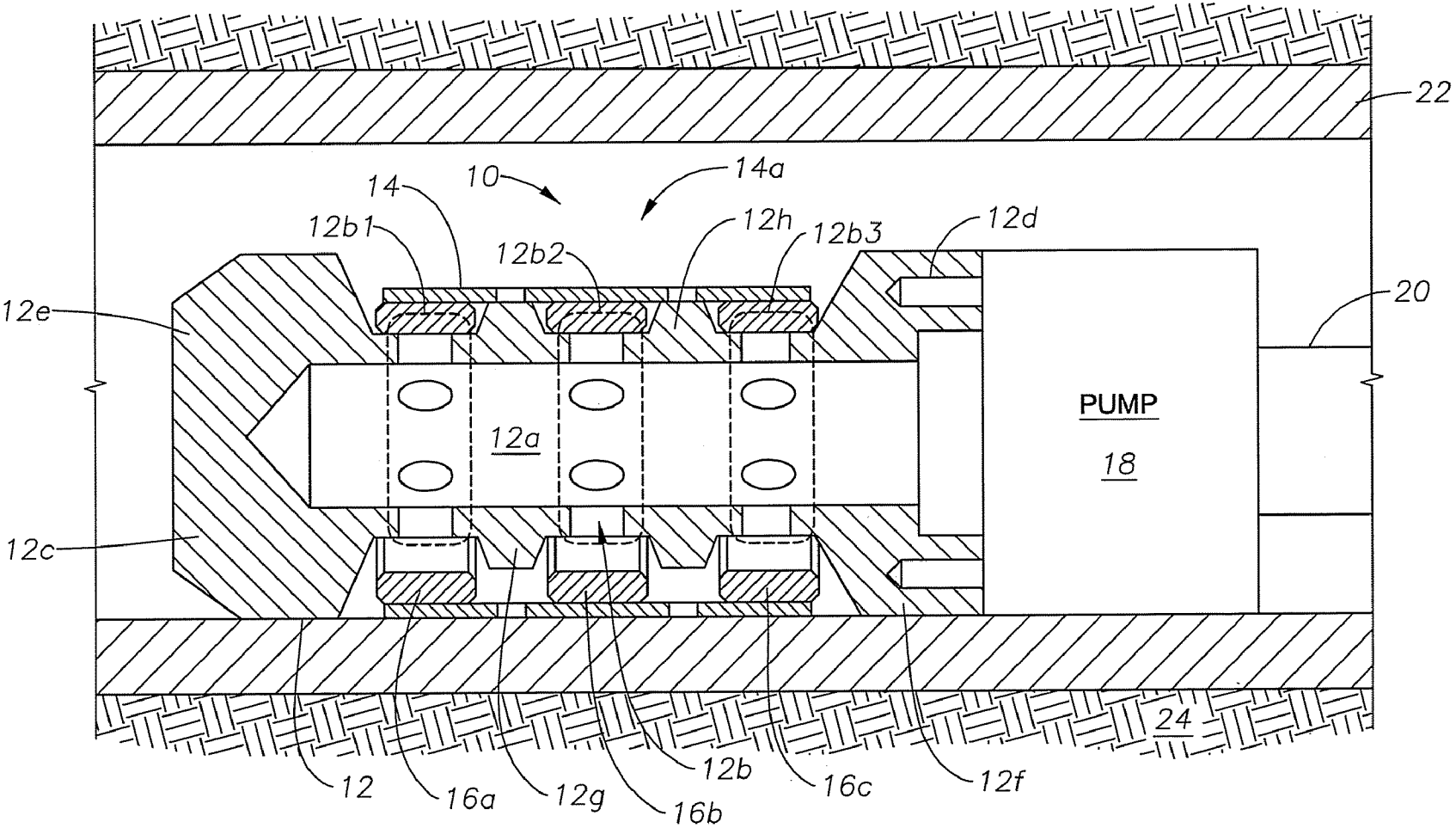
FIG. 1 is a fragmentary cross sectional view of an exemplary embodiment of an intake valve for use with a submersible pump.
Figure 2:
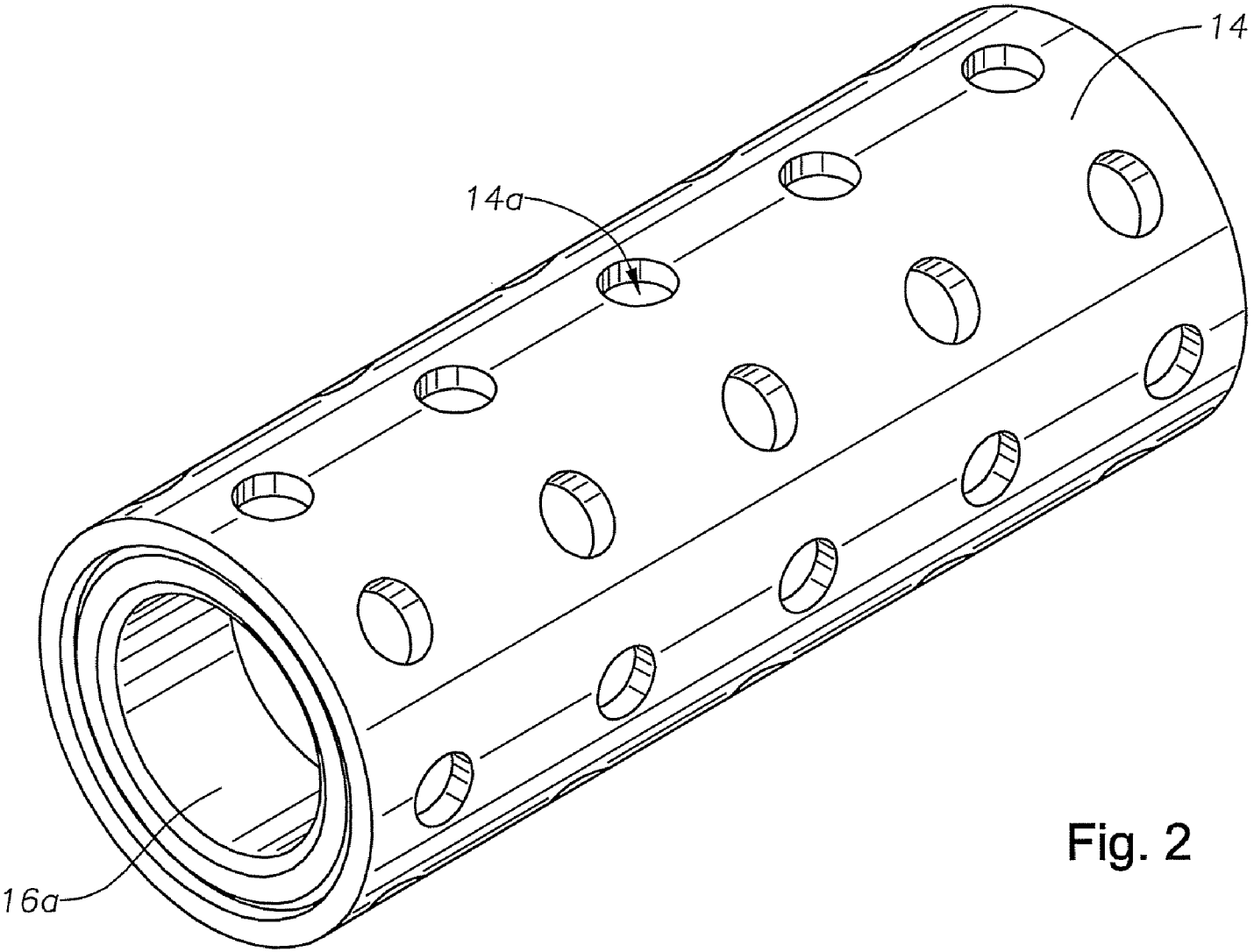
FIG. 2 is a perspective view of the perforated screen and sealing rings of the intake valve of FIG. 1.

Referring initially to FIGS. 1 and 2, an exemplary embodiment of an intake valve 10 for use with a submersible well pump includes a tubular housing 12 that defines a longitudinal passage 12*a* and a plurality of circumferentially and longitudinally spaced apart radial passages 12*b*. In an exemplary embodiment, the radial passages 12*b* are grouped into sets of radial passages, 12*b*1, 12*b*2, and 12*b*3, that are longitudinally spaced apart from one another along the length of the housing 12. In an exemplary embodiment, the housing 12 includes a closed end 12*c*, an open end 12*d*, a tapered external flange 12*e* at the closed end of the housing, a tapered external flange 12*f* at the open end of the housing, an external tapered flange 12*g* positioned between the sets of radial passages, 12*b*1 and 12*b*2, and an external tapered flange 12*h* positioned between the sets of radial passages, 12*b*2 and 12*b*3. In an exemplary embodiment, the outside diameters of the external flanges, 12*e* and 12*f*, are substantially equal and the outside diameters of the external flanges, 12*g* and 12*h*, are substantially equal. In an exemplary embodiment, the outside diameters of the external flanges, 12*e* and 12*f*, are both greater than the outside diameters of the external flanges, 12*g* and 12*h*. A perforated sleeve 14 that defines a plurality of perforations 14*a* receives the portion of the housing 12 positioned between the external flanges, 12*e* and 12*f*, of the housing. Sealing rings, 16*a*, 16*b*, and 16*c* are positioned within and coupled to the inner surface of the perforated sleeve 14. In an exemplary embodiment, the sealing rings, 16*a*, 16*b*, and 16*c*, are spaced apart in the longitudinal direction and are spaced apart such that they may cover one or more of the radial passages within the sets of radial passages, 12*b*1, 12*b*2, and 12*b*3, respectively.

In an exemplary embodiment, as illustrated in FIG. 1, the open end 12*d* of the housing 12 of the intake valve 10 may be coupled to the inlet of a conventional pump 18. In an exemplary embodiment, the pump 18 may be a conventional submersible pump for use in a wellbore. In an exemplary embodiment, the outlet of the pump 18 may be coupled to a pipeline 20, or other form of conduit for conveying the output flow of the pump. In an exemplary embodiment, the inlet valve 10 and pump 18 may be positioned within a wellbore casing 22 that traverses a subterranean formation 24. In an exemplary embodiment, the wellbore casing 22 is inclined and may, for example, be oriented in a direction that is horizontal. In an exemplary embodiment, when the intake valve 10 and pump 18 are positioned within the wellbore casing 22, the external flanges, 12*e* and 12*f*, of the housing 12 of the intake valve rest upon the inner surface of the bottom portion of the wellbore casing.

As illustrated in FIG. 1, in an exemplary embodiment, during operation of the intake valve 10 and pump 18, when the inlet valve and pump are positioned within the wellbore casing 22, the upper portions of the sealing rings, 16*a*, 16*b*, and 16*c*, rest upon and fluidicly seal at least some of the upper radial passages within the sets of radial passages, 12*b*1, 12*b*2, and 12*b*3, respectively. In this manner, fluidic materials within the wellbore casing 22 may enter the passage 12*a* of the housing 12 of the intake valve through the lower radial passages of the sets of radial passages, 12*b*1, 12*b*2, and 12*b*3. In an exemplary embodiment, the fluidic materials within the wellbore casing 22 may include both fluidic and gaseous materials. Typically, the gaseous materials that may be within the wellbore casing 22 will tend to remain in the upper portion of the wellbore casing. As a result, the operation of the intake valve 10 may prevent the intake of the gaseous materials into the pump 18. As will be recognized by persons having ordinary skill in the art, the efficiency of the pump 18 may be adversely affected if such gaseous materials are permitted into the intake of the pump.

As will be recognized by persons having ordinary skill in the art, the design of conventional submersible pump assemblies typically include a motor, pump, and an intermediate seal assembly positioned between the motor and pump. Thus, the exemplary embodiment of FIGS. 1 and 2, if implemented in combination with typical conventional submersible pumps for wellbores would also include a rotary drive shaft extending there through for transmitting torque from the motor to the pump.

Figure 3:
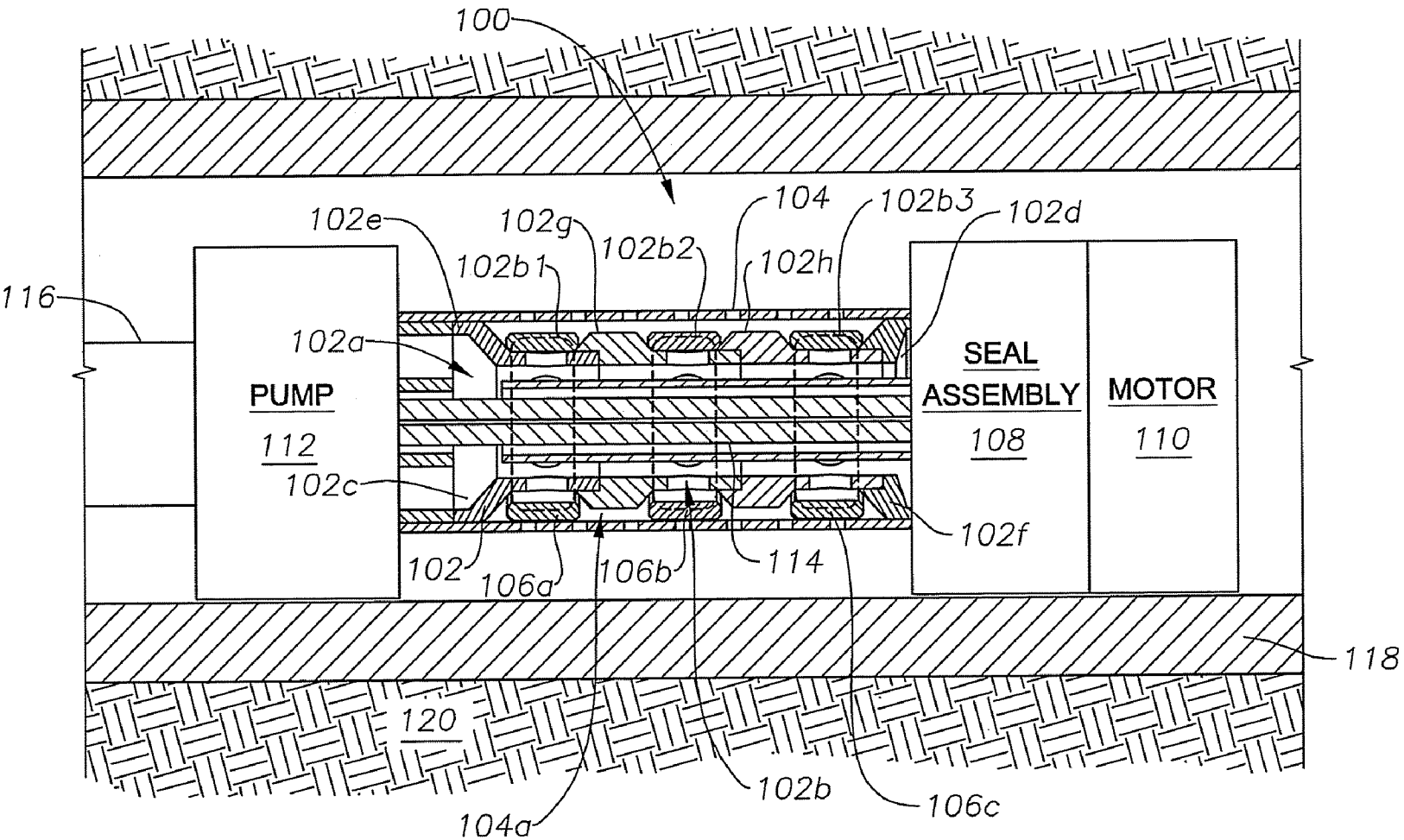
FIG. 3 is a fragmentary cross sectional view of an exemplary embodiment of an intake valve for use with a submersible pump.
Figure 4:
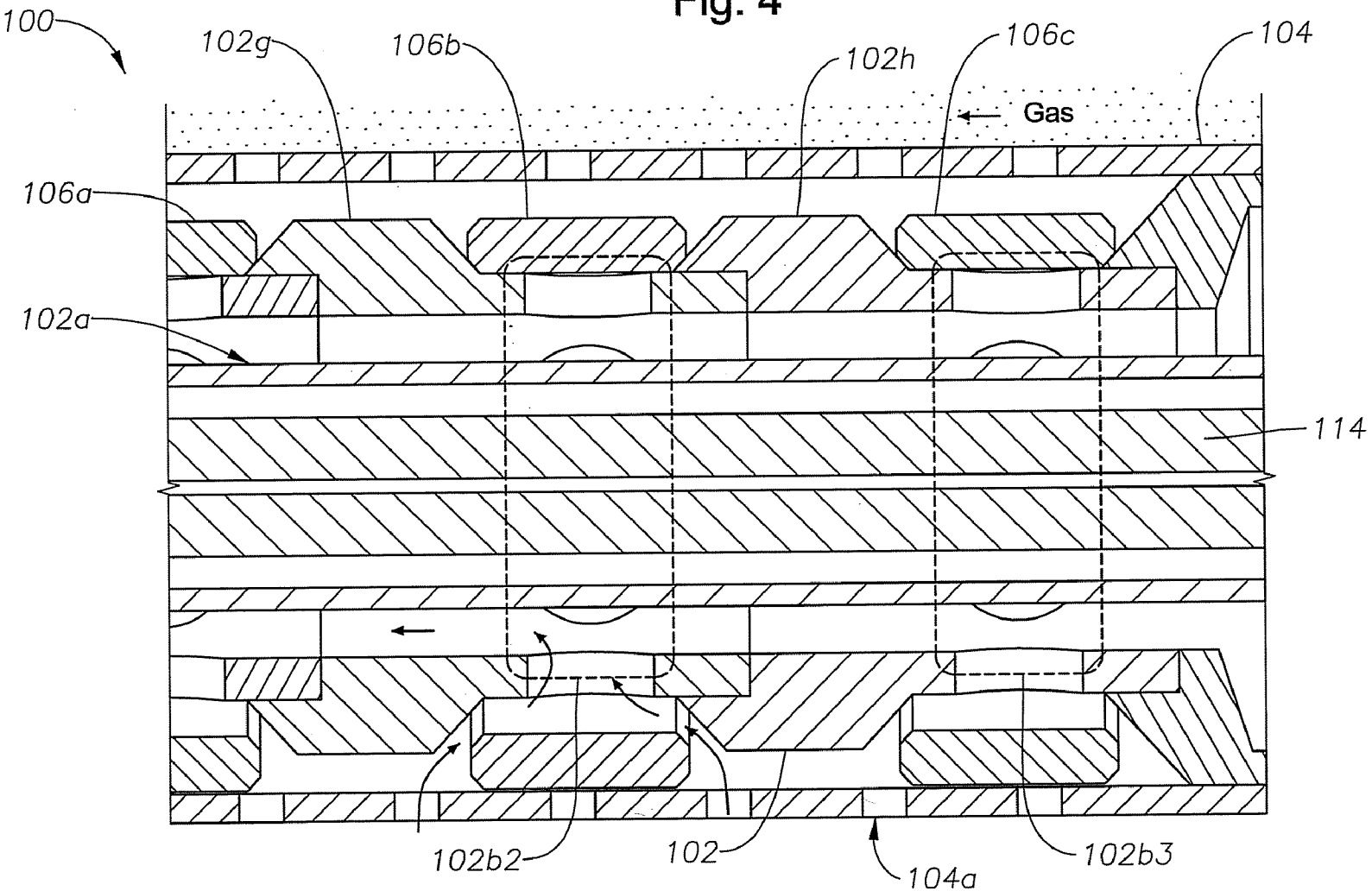
FIG. 4 is a fragmentary cross sectional view of the operation of the sealing rings of the intake valve of FIG. 3.

Referring now to FIGS. 3 and 4, an exemplary embodiment of an intake valve 100 for use with a submersible well pump includes a tubular housing 102 that defines a longitudinal passage 102*a* and a plurality of circumferentially and longitudinally spaced apart radial passages 102*b*. In an exemplary embodiment, the radial passages 102*b* are grouped into sets of radial passages, 102*b*1, 102*b*2, and 102*b*3, that are longitudinally spaced apart from one another along the length of the housing 102. In an exemplary embodiment, the housing 102 includes first and second open ends, 102*c* and 102*d*, a tapered external flange 102*e* at the first open end of the housing, a tapered external flange 102*f* at the second open end of the housing, an external tapered flange 102*g* positioned between the sets of radial passages, 102*b*1 and 102*b*2, and an external tapered flange 102*h* positioned between the sets of radial passages, 102*b*2 and 102*b*3. In an exemplary embodiment, the outside diameters of the external flanges, 102*e* and 102*f*, are substantially equal and the outside diameters of the external flanges, 102*g* and 102*h*, are substantially equal. In an exemplary embodiment, the outside diameters of the external flanges, 102*e* and 102*f*, are both greater than the outside diameters of the external flanges, 102*g* and 102*h*. A perforated sleeve 104 that defines a plurality of perforations 1 04*a* receives the housing 102 and mates with and is coupled to the exterior surfaces of the open ends, 102*c* and 102*d*, of the housing. Sealing rings, 106*a*, 106*b*, and 106*c*, are received within the perforated sleeve 104. In an exemplary embodiment, the sealing rings, 106*a*, 106*b*, and 106*c*, are spaced apart in the longitudinal direction and are spaced apart such that they may cover one or more of the radial passages within the sets of radial passages, 102*b*1, 102*b*2, and 102*b*3, respectively. In an exemplary embodiment, the inside diameters of the sealing rings, 106*a*, 106*b*, and 106*c*, are each less than the outside diameters of the external flanges, 102*g* and 102*h*. In this manner, the sealing rings, 106*a*, 106*b*, and 106*c*, are retained in proximity to the sets of radial passages, 102*b*1, 102*b*2, and 102*b*3, respectively.

In an exemplary embodiment, as illustrated in FIG. 3, the first open end 102*d* of the housing 102 of the intake valve 100 may be coupled to a conventional seal assembly 108 and a conventional motor 110 and the second open end 102*e* of the housing of the intake valve may be coupled to the inlet of a conventional pump 112. As will be recognized by persons having ordinary skill in the art, a drive shaft 114 for transmitting torque from the motor 110 to the pump 112 may then pass through the intake valve 100. The design and operation of the seal assembly 108, motor 110, pump 112, and drive shaft 114 are considered will known to persons having ordinary skill in the art.

In an exemplary embodiment, the outlet of the pump 112 may be coupled to a pipeline 116, or other form of conduit for conveying the output flow of the pump. In an exemplary embodiment, the inlet valve 100, seal assembly 108, motor 110, and pump 112 may be positioned within a wellbore casing 118 that traverses a subterranean formation 120. In an exemplary embodiment, the wellbore casing 118 is inclined and may, for example, be oriented in a direction that is horizontal. In an exemplary embodiment, when the inlet valve 100, seal assembly 108, motor 110, and pump 112 are positioned within the wellbore casing 118, the perforated sleeve 104 of the intake valve rests upon the inner surface of the bottom portion of the wellbore casing.

As illustrated in FIGS. 3 and 4, in an exemplary embodiment, during operation of the intake valve 100, when the inlet valve, seal assembly 108, motor 110, and pump 112 are positioned within the wellbore casing 118, the upper portions of the sealing rings, 106*a*, 106*b*, and 106*c*, rest upon and fluidicly seal at least some of the upper radial passages within the sets of radial passages, 102*b*1, 102*b*2, and 102*b*3, respectively. In this manner, fluidic materials within the wellbore casing 118 may enter the passage 102*a* of the housing 102 of the intake valve through the lower radial passages of the sets of radial passages, 102*b*1, 102*b*2, and 102*b*3. In an exemplary embodiment, the fluidic materials within the wellbore casing 118 may include both fluidic and gaseous materials. Typically, the gaseous materials that may be within the wellbore casing 118 will tend to remain in the upper portion of the wellbore casing. As a result, the operation of the intake valve 100 may prevent the intake of the gaseous materials into the pump 112. As will be recognized by persons having ordinary skill in the art, the efficiency of the pump 112 may be adversely affected if such gaseous materials are permitted into the intake of the pump.

Figure 5:
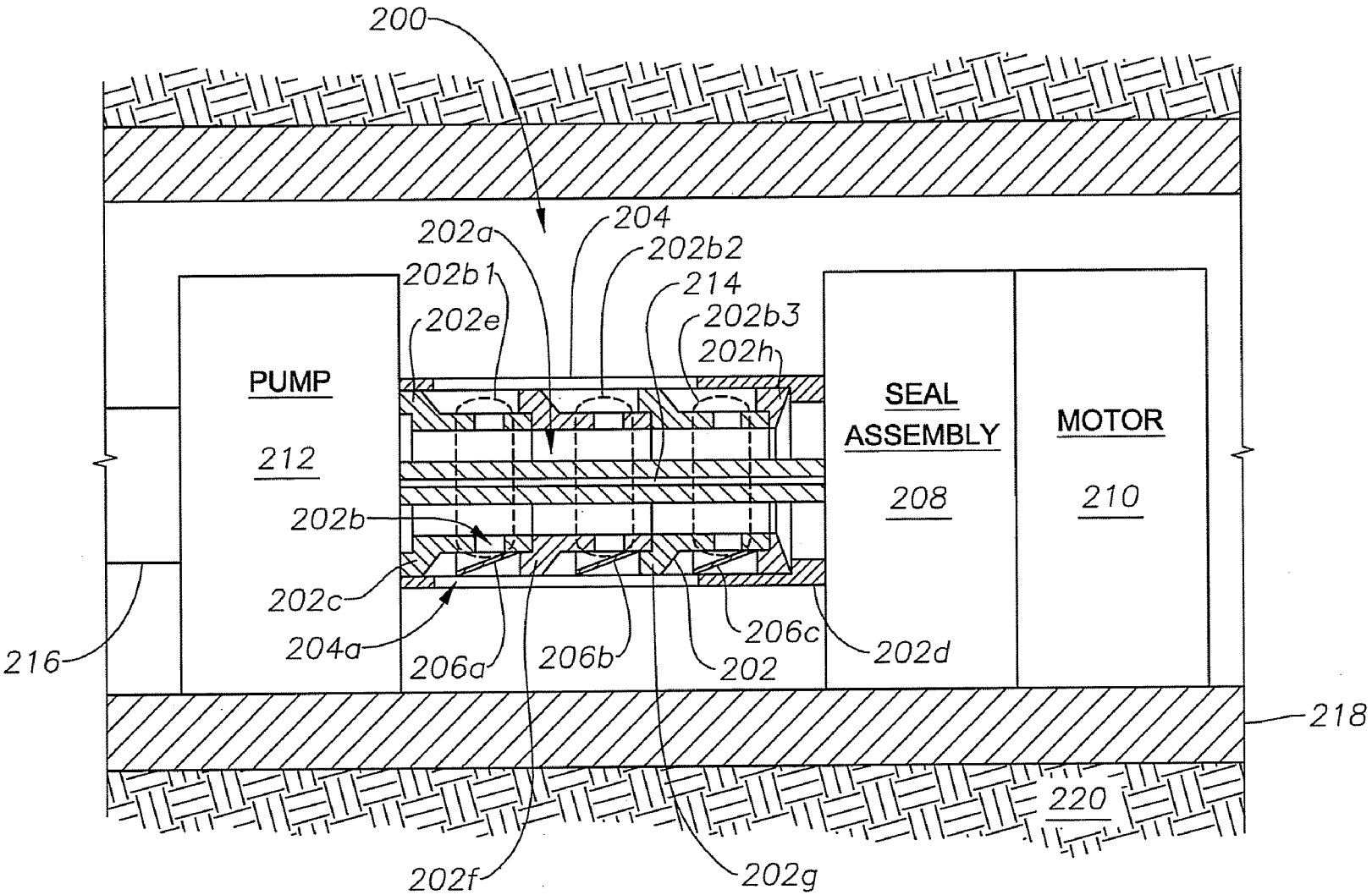
FIG. 5 is a fragmentary cross sectional view of an exemplary embodiment of an intake valve for use with a submersible pump.
Figure 6:
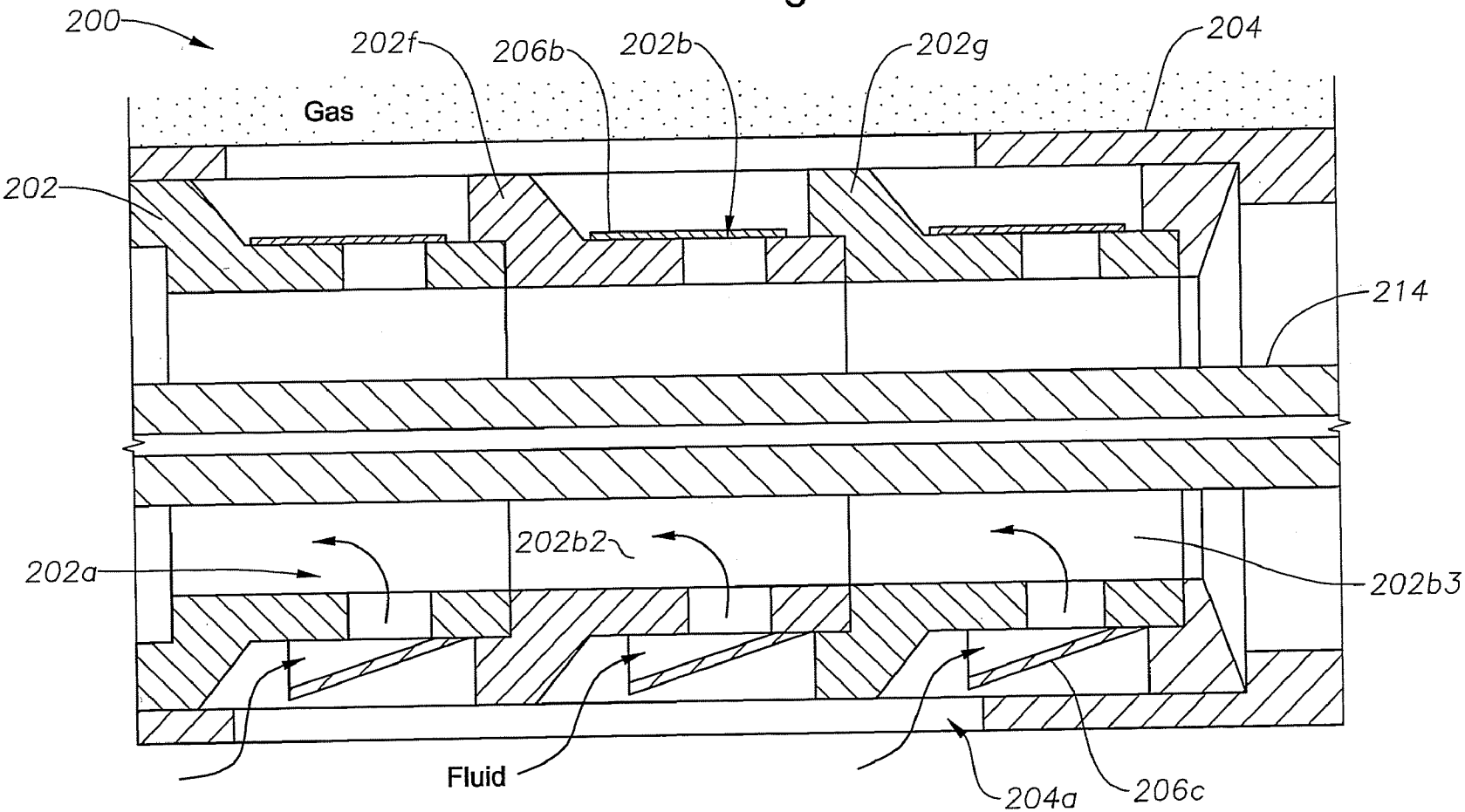
FIG. 6 is a fragmentary cross sectional view of the operation of the tapered sealing rings of the intake valve of FIG. 5.

Referring now to FIGS. 5 and 6, an exemplary embodiment of an intake valve 200 for use with a submersible well pump includes a tubular housing 202 that defines a longitudinal passage 202*a* and a plurality of circumferentially and longitudinally spaced apart radial passages 202*b*. In an exemplary embodiment, the radial passages 202*b* are grouped into sets of radial passages, 202*b*1, 202*b*2, and 202*b*3, that are longitudinally spaced apart from one another along the length of the housing 202. In an exemplary embodiment, the housing 202 includes first and second open ends, 202*c* and 202*d*, a tapered external flange 202*e* positioned at the first open end of the housing, a tapered external flange 202*f* positioned between the sets of radial passages, 202*b*1 and 202*b*2, a tapered external flange 202*g* positioned between the sets of radial passages, 202*b*2 and 202*b*3, and an external flange 202*h* positioned at the second open end of the housing. In an exemplary embodiment, the outside diameters of the external flanges, 202*e*, 202*f*, 202*g*, and 202*h* are substantially equal. A perforated sleeve 204 that defines a plurality of perforations 204*a* receives the housing 202 and mates with and is coupled to the exterior surfaces of the open ends, 202*c* and 202*d*, of the housing. Tapered sealing rings, 206*a*, 206*b*, and 206*c*, are received within the perforated sleeve 204 and each receive portions of the housing 202. In an exemplary embodiment, the sealing rings, 206*a*, 206*b*, and 206*c*, are spaced apart in the longitudinal direction and are spaced apart such that they may cover one or more of the radial passages within the sets of radial passages, 202*b*1, 202*b*2, and 202*b*3, respectively. In an exemplary embodiment, each of the tapered sealing rings, 206*a*, 206*b*, and 206*c*, include a first end having a first inside diameter and a second end having a second inside diameter that is greater than the first inside diameter. In an exemplary embodiment, the ends of the sealing rings, 206*a*, 206*b*, and 206*c*, having the smaller first inside diameters are positioned proximate the tapered external flanges, 202*e*, 202*f*, and 202*g*, respectively. In this manner, the sealing rings, 206*a*, 206*b*, and 206*c*, are retained in proximity to the sets of radial passages, 202*b*1, 202*b*2, and 202*b*3, respectively.

In an exemplary embodiment, as illustrated in FIG. 5, the first open end 202*d* of the housing 202 of the intake valve 200 may be coupled to a conventional seal assembly 208 and a conventional motor 210 and the second open end 202*e* of the housing of the intake valve may be coupled to the inlet of a conventional pump 212. As will be recognized by persons having ordinary skill in the art, a drive shaft 214 for transmitting torque from the motor 210 to the pump 212 may then pass through the intake valve 200. The design and operation of the seal assembly 208, motor 210, pump 212, and drive shaft 214 are considered will known to persons having ordinary skill in the art.

In an exemplary embodiment, the outlet of the pump 212 may be coupled to a pipeline 216, or other form of conduit for conveying the output flow of the pump. In an exemplary embodiment, the inlet valve 200, seal assembly 208, motor 210, and pump 212 may be positioned within a wellbore casing 218 that traverses a subterranean formation 220. In an exemplary embodiment, the wellbore casing 218 is inclined and may, for example, be oriented in a direction that is horizontal. In an exemplary embodiment, when the inlet valve 200, seal assembly 208, motor 210, and pump 212 are positioned within the wellbore casing 218, the perforated sleeve 204 of the intake valve rests upon the inner surface of the bottom portion of the wellbore casing.

As illustrated in FIGS. 5 and 6, in an exemplary embodiment, during operation of the intake valve 200, when the inlet valve, seal assembly 208, motor 210, and pump 212 are positioned within the wellbore casing 218, the upper portions of the tapered sealing rings, 206*a*, 206*b*, and 206*c*, rest upon and fluidicly seal at least some of the upper radial passages within the sets of radial passages, 202*b*1, 202*b*2, and 202*b*3, respectively. In this manner, fluidic materials within the wellbore casing 218 may enter the passage 202*a* of the housing 202 of the intake valve through the lower radial passages of the sets of radial passages, 202*b*1, 202*b*2, and 202*b*3. In an exemplary embodiment, the fluidic materials within the wellbore casing 218 may include both fluidic and gaseous materials. Typically, the gaseous materials that may be within the wellbore casing 218 will tend to remain in the upper portion of the wellbore casing. As a result, the operation of the intake valve 200 may prevent the intake of the gaseous materials into the pump 212. As will be recognized by persons having ordinary skill in the art, the efficiency of the pump 212 may be adversely affected if such gaseous materials are permitted into the intake of the pump.

Figure 7:
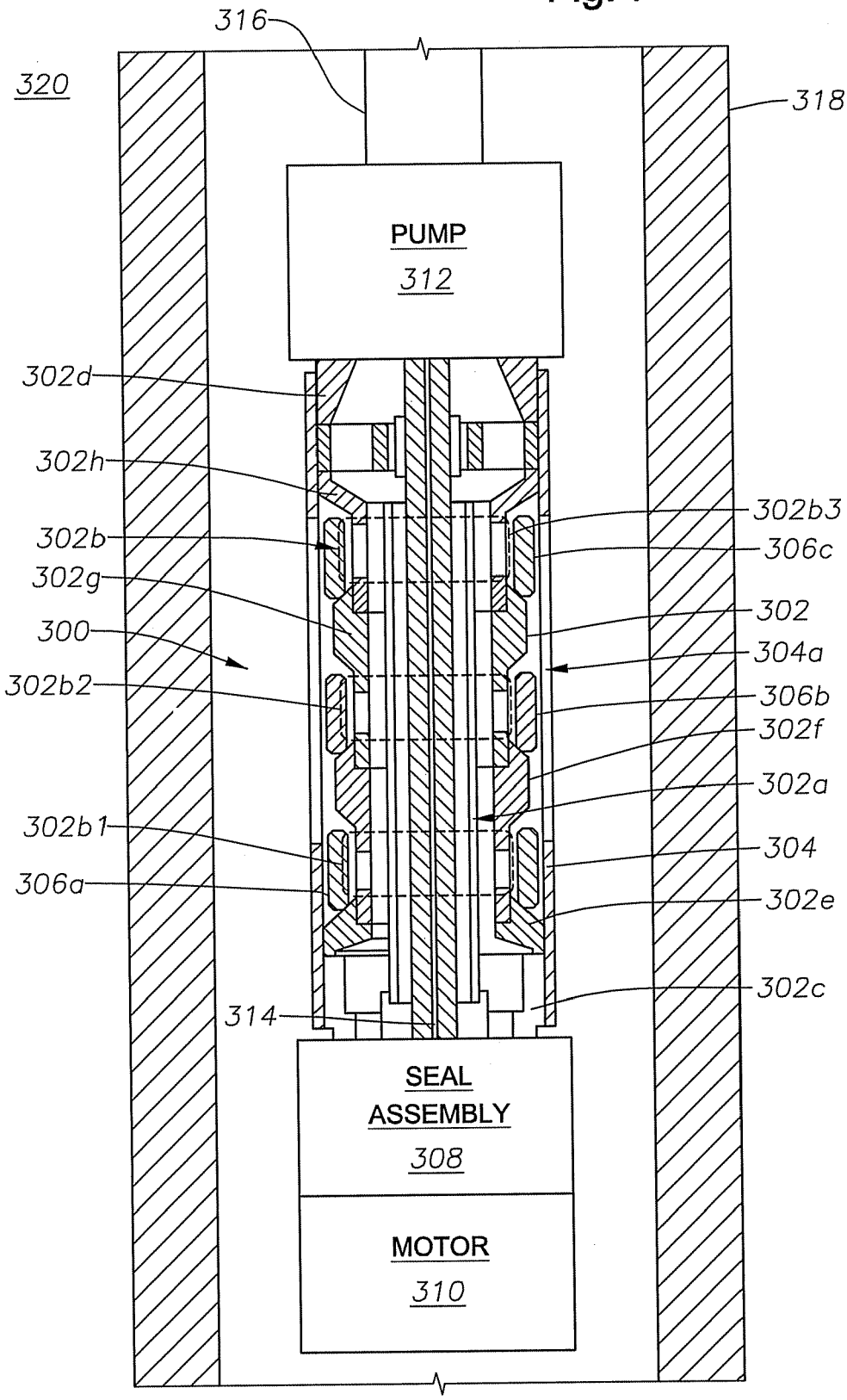
FIG. 7 is a fragmentary cross sectional view of an exemplary embodiment of an intake valve for use with a submersible pump.
Figure 8:
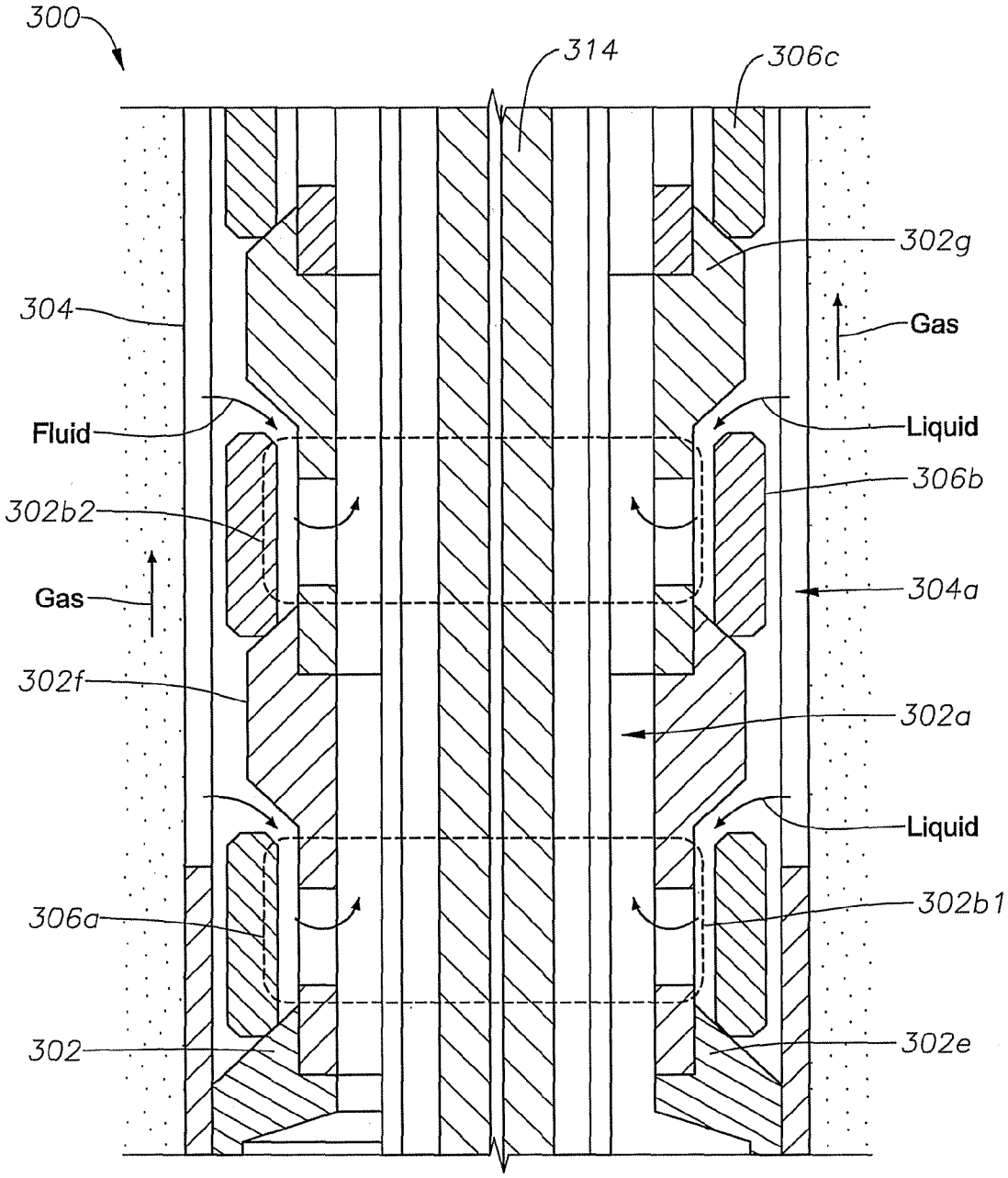
FIG. 8 is a fragmentary cross sectional view of the operation of the sealing rings of the intake valve of FIG. 7.

Referring now to FIGS. 7 and 8, an exemplary embodiment of an intake valve 300 for use with a submersible well pump includes a tubular housing 302 that defines a longitudinal passage 302*a* and a plurality of circumferentially and longitudinally spaced apart radial passages 302*b*. In an exemplary embodiment, the radial passages 302*b* are grouped into sets of radial passages, 302*b*1, 302*b*2, and 302*b*3, that are longitudinally spaced apart from one another along the length of the housing 302. In an exemplary embodiment, the housing 302 includes first and second open ends, 302*c* and 302*d*, a tapered external flange 302*e* positioned at the first open end of the housing, a tapered external flange 302*f* positioned between the sets of radial passages, 302*b*1 and 302*b*2, a tapered external flange 302*g* positioned between the sets of radial passages, 302*b*2 and 302*b*3, and an external flange 302*h* positioned at the second open end of the housing. In an exemplary embodiment, the outside diameters of the external flanges, 302*e* and 302*h*, are substantially equal and the outside diameters of the external flanges, 302*f* and 302*g*, are substantially equal. In an exemplary embodiment, the outside diameters of the external flanges, 302*e* and 302*h*, are both greater than the outside diameters of the external flanges, 302*f* and 302*g*. A perforated sleeve 304 that defines a plurality of perforations 304*a* receives the housing 302 and mates with and is coupled to the exterior surfaces of the open ends, 302*c* and 302*d*, of the housing. Sealing rings, 306*a*, 306*b*, and 306*c*, are received within the perforated sleeve 304 and each receive portions of the housing 302. In an exemplary embodiment, the sealing rings, 306*a*, 306*b*, and 306*c*, are spaced apart in the longitudinal direction and are spaced apart such that they may cover one or more of the radial passages within the sets of radial passages, 302*b*1, 302*b*2, and 302*b*3, respectively. In an exemplary embodiment, the inside diameters of sealing rings, 306*a*, 306*b*, and 306*c*, are less than each of the outside diameters of the tapered external flanges, 302*f* and 302*g*. In this manner, the sealing rings, 306*a*, 306*b*, and 306*c*, are retained in proximity to the sets of radial passages, 302*b*1, 302*b*2, and 302*b*3, respectively, In an exemplary embodiment, as illustrated in FIG. 7, the first open end 302*c* of the housing 302 of the intake valve 300 may be coupled to a conventional seal assembly 308 and a conventional motor 310 and the second open end 302*d* of the housing of the intake valve may be coupled to the inlet of a conventional pump 312. As will be recognized by persons having ordinary skill in the art, a drive shaft 314 for transmitting torque from the motor 310 to the pump 312 may then pass through the intake valve 300. The design and operation of the seal assembly 308, motor 310, pump 312, and drive shaft 314 are considered will known to persons having ordinary skill in the art.

In an exemplary embodiment, the outlet of the pump 312 may be coupled to a pipeline 316, or other form of conduit for conveying the output flow of the pump. In an exemplary embodiment, the inlet valve 300, seal assembly 308, motor 310, and pump 312 may be positioned within a wellbore casing 318 that traverses a subterranean formation 320. In an exemplary embodiment, the wellbore casing 318 is inclined and may, for example, be oriented in a direction that is vertical.

As illustrated in FIGS. 7 and 8, in an exemplary embodiment, during operation of the intake valve 300, when the inlet valve, seal assembly 308, motor 310, and pump 312 are positioned within the wellbore casing 318, the lower end faces of each of the sealing rings, 306*a*, 306*b*, and 306*c*, rest upon the tapered edges of the tapered external flanges, 302*e*, 302*f*, and 302*g*, respectively, thereby sealing the interface between the lower end faces of the tapered sealing rings, 306*a*, 306*b*, and 306*c*, and tapered edges of the tapered external flanges, 302*e*, 302*f*, and 302*g*, respectively. As a result, fluidic materials within the wellbore casing 318 must travel up and over the upper end faces of each of the sealing rings, 306*a*, 306*b*, and 306*c*, in a serpentine path, in order to pass into and through the sets of radial passages, 302*b*1, 302*b*2, and 302*b*3, respectively, into the passage 302*a* of the housing 302 of the intake valve 300.

In an exemplary embodiment, the fluidic materials within the wellbore casing 318 may include both fluidic and gaseous materials. Since the gaseous materials within the wellbore casing 318 will tend to be displaced upwardly relative to the fluidic materials within the wellbore casing 318, due to their buoyancy, the flow path provided by the operation of the intake valve 300 will tend to prevent the gaseous materials within the wellbore casing from entering the intake valve. In effect, the design and operation of the sealing rings, 306*a*, 306*b*, and 306*c*, of the intake valve 300 provide a gas separator for separating gaseous material from the fluidic materials within the wellbore casing 318 prior to the intake of fluidic materials into the intake valve. As will be recognized by persons having ordinary skill in the art, the efficiency of the pump 312 may be adversely affected if such gaseous materials are permitted into the intake of the pump.

Figure 9:
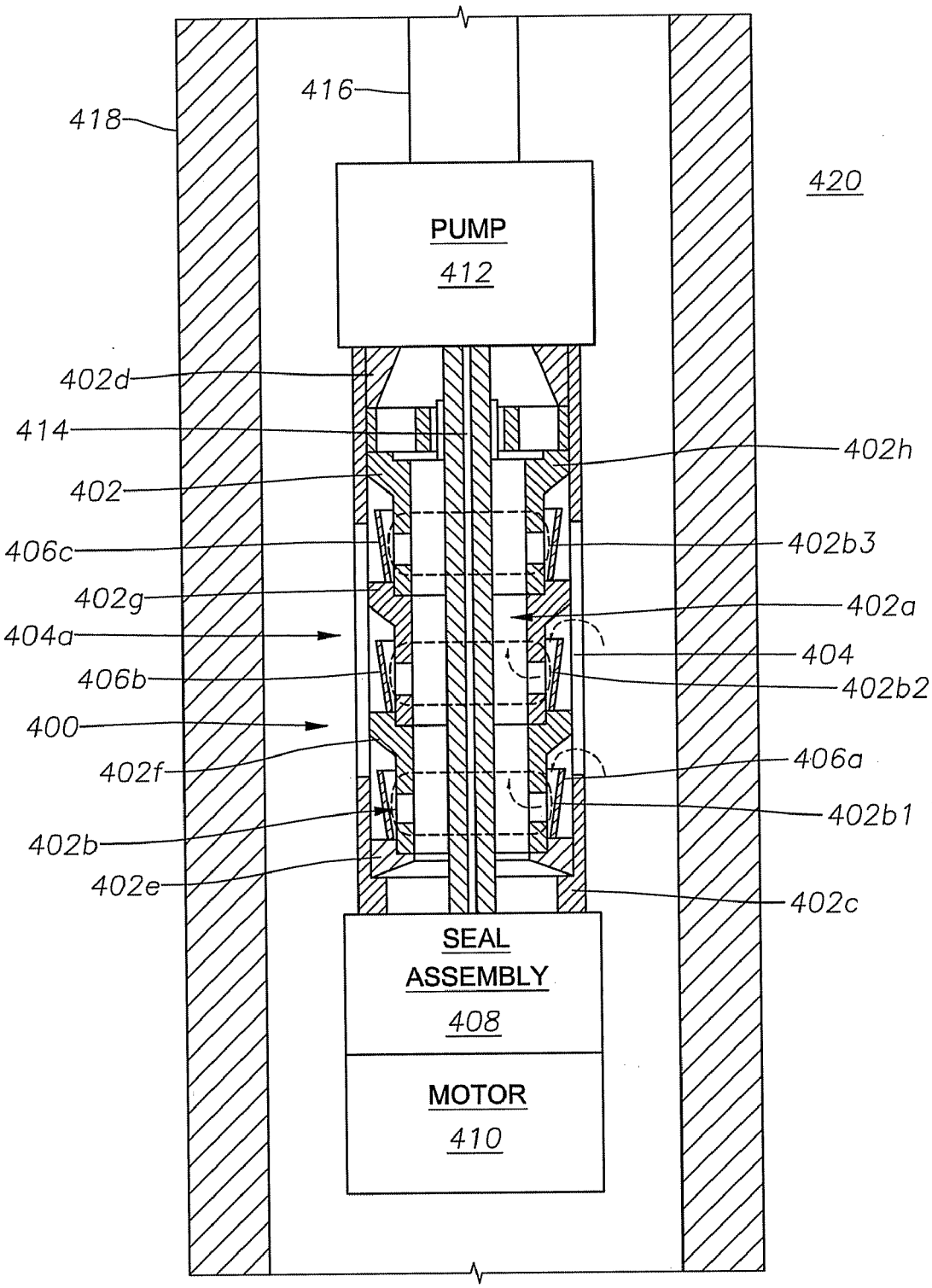
FIG. 9 is a fragmentary cross sectional view of an exemplary embodiment of an intake valve for use with a submersible pump.
Figure 10:
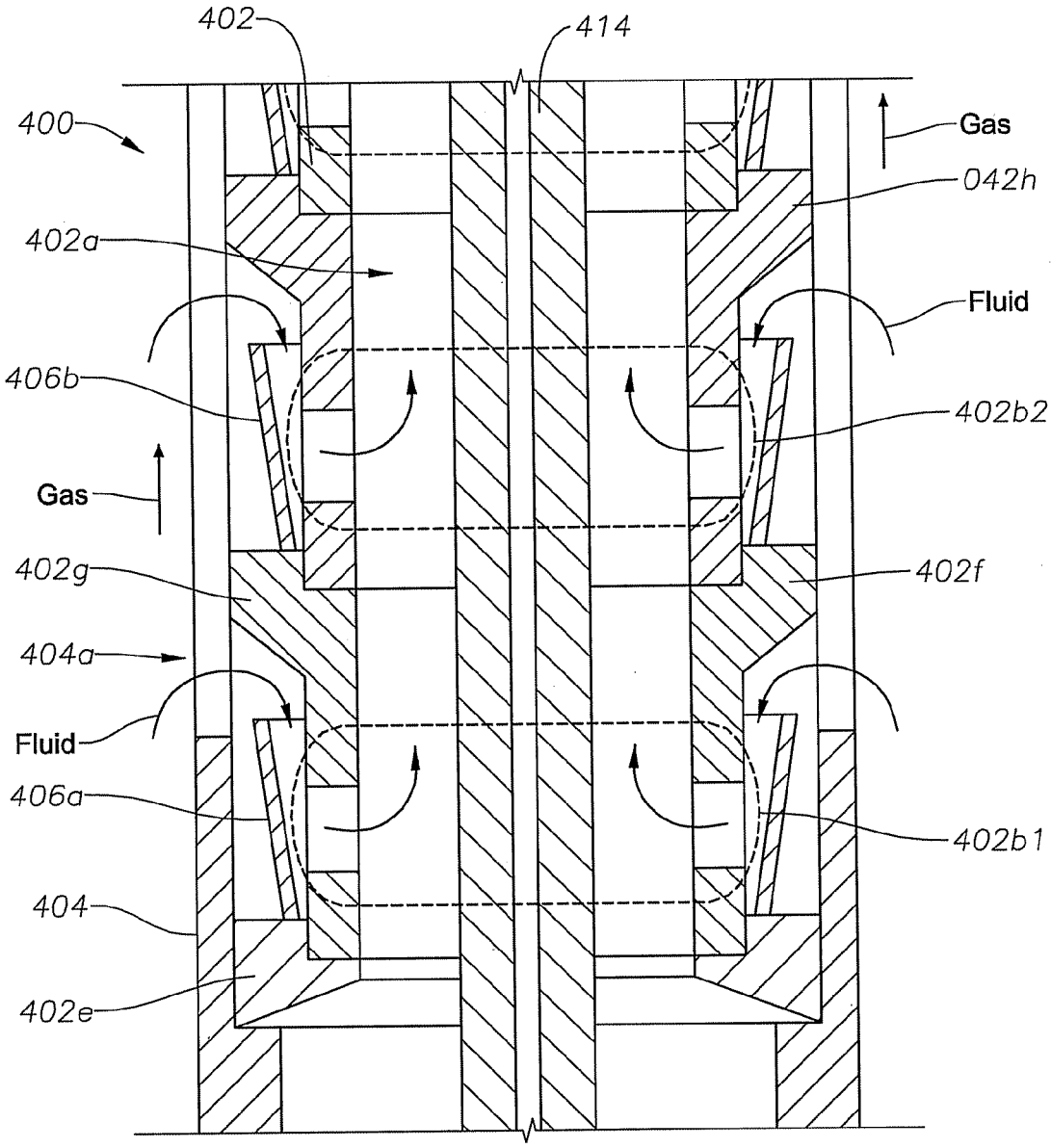
FIG. 10 is a fragmentary cross sectional view of the operation of the tapered sealing rings of the intake valve of FIG. 9.

Referring now to FIGS. 9 and 10, an exemplary embodiment of an intake valve 400 for use with a submersible well pump includes a tubular housing 402 that defines a longitudinal passage 402*a* and a plurality of circumferentially and longitudinally spaced apart radial passages 402*b*. In an exemplary embodiment, the radial passages 402*b* are grouped into sets of radial passages, 402*b*1, 402*b*2, and 402*b*3, that are longitudinally spaced apart from one another along the length of the housing 402. In an exemplary embodiment, the housing 402 includes first and second open ends, 402*c* and 402*d*, an external flange 402*e* positioned adjacent the first open end of the housing, an external flange 402*f* positioned between the sets of radial passages, 402*b*1 and 402*b*2, an external flange 402*g* positioned between the sets of radial passages, 402*b*2 and 402*b*3, and an external flange 402*h* positioned proximate the second open end of the housing. In an exemplary embodiment, the outside diameters of the external flanges, 402*e*, 402*f*, 402*g*, and 402*b* are substantially equal. A perforated sleeve 404 that defines a plurality of perforations 404*a* receives the housing 402 and mates with and is coupled to the exterior surfaces of the open ends, 402*c* and 402*d*, of the housing.

Tapered sealing rings, 406*a*, 406*b*, and 406*c*, are received within the perforated sleeve 404 and each receive corresponding portions of the housing 402. In an exemplary embodiment, the sealing rings, 406*a*, 406*b*, and 406*c*, are spaced apart in the longitudinal direction and are spaced apart such that they may cover one or more of the radial passages within the sets of radial passages, 402*b*1, 402*b*2, and 402*b*3, respectively. In an exemplary embodiment, each of the tapered sealing rings, 406*a*, 406*b*, and 406*c*, include a first end having a first inside diameter and a second end having a second inside diameter that is greater than the first inside diameter. In an exemplary embodiment, the ends of the sealing rings, 406*a*, 406*b*, and 406*c*, having the smaller first inside diameters are positioned proximate the tapered external flanges, 402*e*, 402*f*, and 402*g*, respectively. In this manner, the sealing rings, 406*a*, 406*b*, and 406*c*, are retained in proximity to the sets of radial passages, 402*b*1, 402*b*2, and 402*b*3, respectively.

In an exemplary embodiment, as illustrated in FIG. 9, the first open end 402*e* of the housing 402 of the intake valve 400 may be coupled to a conventional seal assembly 408 and a conventional motor 410 and the second open end 402*d* of the housing of the intake valve may be coupled to the inlet of a conventional pump 412. As will be recognized by persons having ordinary skill in the art, a drive shaft 414 for transmitting torque from the motor 410 to the pump 412 may then pass through the intake valve 400. The design and operation of the seal assembly 408, motor 410, pump 412, and drive shaft 414 are considered will known to persons having ordinary skill in the art.

In an exemplary embodiment, the outlet of the pump 412 may be coupled to a pipeline 416, or other form of conduit for conveying the output flow of the pump, In an exemplary embodiment, the inlet valve 400, seal assembly 408, motor 410, and pump 412 may be positioned within a wellbore casing 418 that traverses a subterranean formation 420. In an exemplary embodiment, the wellbore casing 418 is inclined and may, for example, be oriented in a direction that is vertical.

As illustrated in FIGS. 9 and 10, in an exemplary embodiment, during operation of the intake valve 400, when the inlet valve, seal assembly 408, motor 410, and pump 412 are positioned within the wellbore casing 418, the smaller first ends of the tapered sealing rings, 406*a*, 406*b*, and 406*c*, rest upon, and fluidicly seal the interface with, the opposing surfaces of the external flanges, 402*e*, 402*f*, and 402*g*, respectively. As a result, fluidic materials within the wellbore casing 418 may only enter the passage 402*a* of the housing 402 of the intake valve 400 by passing up and over the second large diameter ends of the tapered sealing rings, 406*a*, 406*b*, and 406*c*, in a serpentine path, and then into and through the radial passages of the sets of radial passages, 402*b*1, 402*b*2, and 402*b*3.

In an exemplary embodiment, the fluidic materials within the wellbore casing 418 may include both fluidic and gaseous materials. Since the gaseous materials within the wellbore casing 418 will tend to be displaced upwardly relative to the fluidic materials within the wellbore casing 418, due to their buoyancy, the flow path provided by the operation of the intake valve 400 will tend to prevent the gaseous materials within the wellbore casing from entering the intake valve. In effect, the design and operation of the tapered sealing rings, 406*a*, 406*b*, and 406*c*, of the intake valve 400 provide a gas separator for separating gaseous material from the fluidic materials within the wellbore casing 418 prior to the intake of fluidic materials into the intake valve. As will be recognized by persons having ordinary skill in the art, the efficiency of the pump 412 may be adversely affected if such gaseous materials are permitted into the intake of the pump.

Figure 12:
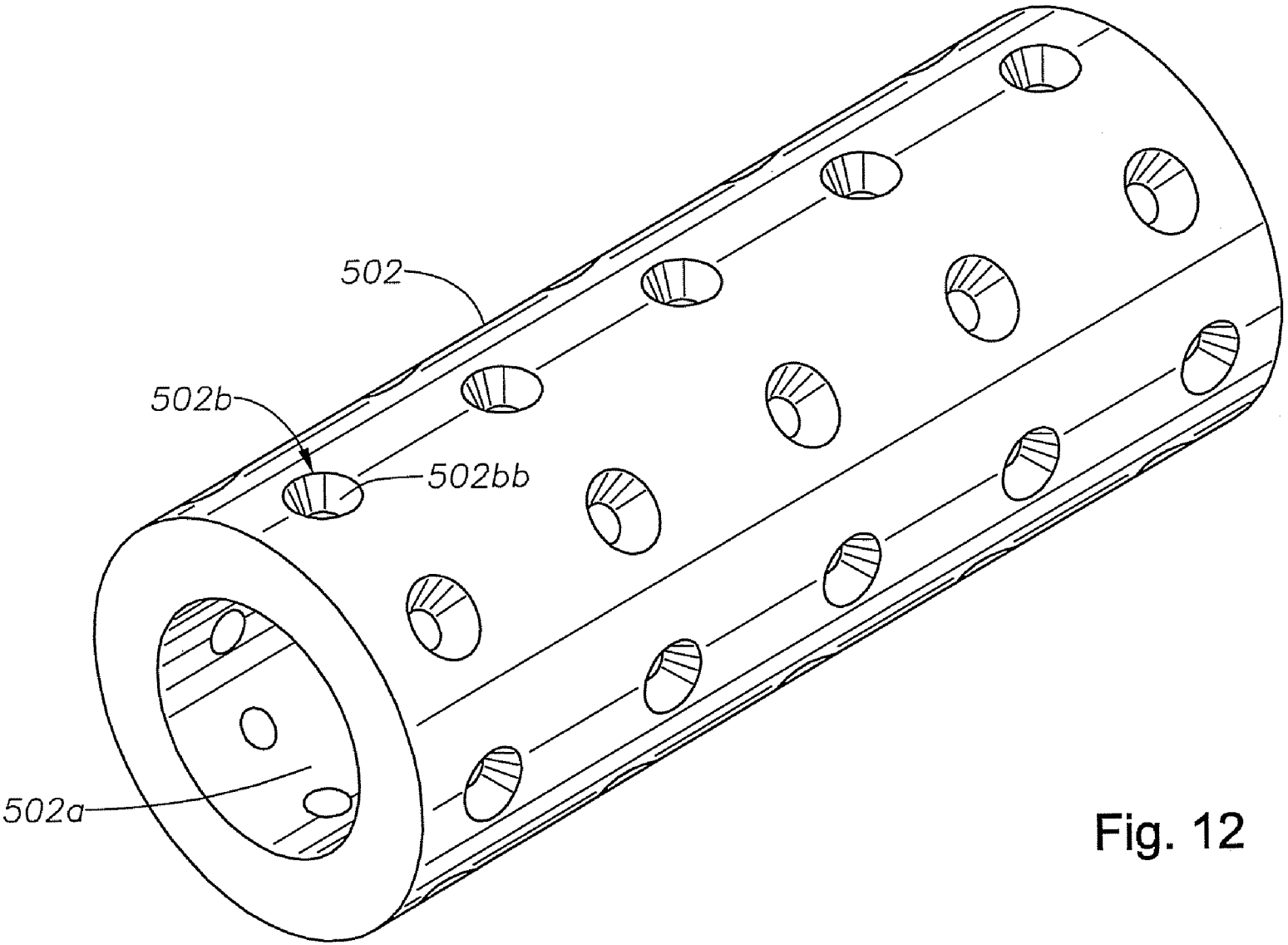
FIG. 12 is a perspective view of the housing of the intake valve of FIG. 11.

Referring now to FIGS. 11, 12 and 13, an exemplary embodiment of an intake valve 500 for use with a submersible well pump includes a tubular housing 502 that defines a longitudinal passage 502*a* and a plurality of circumferentially and longitudinally spaced apart radial passages 502*b*. In an exemplary embodiment, the radial passages 502*b* are cone shaped within a smaller circular opening 502*ba* at one end that opens into the passage 502*a* of the housing 502 and a larger circular opening 502*bb* at another end that opens into the exterior of the housing. In an exemplary embodiment, the housing 502 also includes first and second open ends, 502*c* and 502*d*.

A perforated sleeve 504 that defines a plurality of perforations 104*a* receives, mates with, and is coupled to the housing 502. Sealing balls 506 are positioned each of the radial passages 502*b* of the housing 502 of the intake valve 500. In an exemplary embodiment, the sealing balls 506 are retained within the corresponding radial passages 502*b* by the perforated sleeve 504 that receives, mates with, and is coupled to the exterior surface of the housing 502. In an exemplary embodiment, the outside diameters of the sealing balls 506 are each greater than the diameters of the openings 502*ba* of the radial passages 502*b*. In this manner, when the sealing balls 506 rest on the openings 502*ba* of the radial passages 502*b*, the sealing balls prevent the flow of fluidic material there through thereby providing a check valve.

In an exemplary embodiment, as illustrated in FIG. 11, the first open end 502*c* of the housing 502 of the intake valve 500 may be coupled to a conventional seal assembly 508 and a conventional motor 110 and the second open end 502*d* of the housing of the intake valve may be coupled to the inlet of a conventional pump 512. As will be recognized by persons having ordinary skill in the art, a drive shaft 514 for transmitting torque from the motor 510 to the pump 512 may then pass through the intake valve 500. The design and operation of the seal assembly 508, motor 510, pump 512, and drive shaft 514 are considered will known to persons having ordinary skill in the art.

In an exemplary embodiment, the outlet of the pump 512 may be coupled to a pipeline 516, or other form of conduit for conveying the output flow of the pump. In an exemplary embodiment, the inlet valve 500, seal assembly 508, motor 510, and pump 512 may be positioned within a wellbore casing 518 that traverses a subterranean formation 520. In an exemplary embodiment, the wellbore casing 518 is inclined and may, for example, be oriented in a direction that is horizontal.

As illustrated in FIG. 13, in an exemplary embodiment, during operation of the intake valve 500, when the inlet valve, seal assembly 508, motor 510, and pump 512 are positioned within the wellbore casing 518, upper sealing balls, 506*a*, rest upon and fluidicly seal the corresponding openings 502*ba* of the corresponding radial passages 502*b* while lower sealing balls, 506*b*, are displaced out of engagement with the corresponding openings 502*ba* of the corresponding radial passages 502*b*. As a result, fluidic materials within the wellbore casing 518 may enter and pass through the lower radial passages 502*b* of the housing 502 of the intake valve 500. In an exemplary embodiment, the fluidic materials within the wellbore casing 518 may include both fluidic and gaseous materials. Typically, the gaseous materials that may be within the wellbore casing 518 will tend to remain in the upper portion of the wellbore casing. As a result, the operation of the intake valve 500 may prevent the intake of the gaseous materials into the pump 512. As will be recognized by persons having ordinary skill in the art, the efficiency of the pump 512 may be adversely affected if such gaseous materials are permitted into the intake of the pump, Referring now to FIGS. 14 and 15, an exemplary embodiment of an intake valve 600 for use with a submersible well pump includes a tubular housing 602 that defines a longitudinal passage 602*a* and a plurality of circumferentially spaced and longitudinally aligned and elongated radial passages 602*b*. In an exemplary embodiment, the radial passages 602*b* include an opening 602*ba* at one end that opens into the passage 602*a* of the housing and a parabolic shaped opening 602*bb* at the other end that opens into the exterior of the housing. In an exemplary embodiment, the housing 602 also includes first and second open ends, 602*c* and 602*d*.

A perforated sleeve 604 that defines a plurality of perforations 604*a* receives, mates with, and is coupled to the housing 502. Elongated sealing elements 606 are positioned each of the radial passages 602*b* of the housing 602 of the intake valve 600. In an exemplary embodiment, the sealing elements 606 are retained within the corresponding radial passages 602*b* by the perforated sleeve 604 that receives, mates with, and is coupled to the exterior surface of the housing 602. In an exemplary embodiment, the outside diameters of the sealing elements 606 are each greater than the widths of the corresponding openings 602*ba* of the corresponding radial passages 602 and the lengths of the sealing elements 606 are each greater than the lengths of the corresponding openings of the corresponding radial passages 602. In this manner, when the sealing elements 606 rest on the openings 602*ba* of the radial passages 602*b*, the sealing elements prevent the flow of fluidic material there through thereby providing a check valve.

In an exemplary embodiment, as illustrated in FIG. 14, the first open end 602*c* of the housing 602 of the intake valve 600 may be coupled to a conventional seal assembly 608 and a conventional motor 610 and the second open end 602*d* of the housing of the intake valve may be coupled to the inlet of a conventional pump 612. As will be recognized by persons having ordinary skill in the art, a drive shaft 614 for transmitting torque from the motor 610 to the pump 612 may then pass through the intake valve 600. The design and operation of the seal assembly 608, motor 610, pump 612, and drive shaft 614 are considered will known to persons having ordinary skill in the art.

In an exemplary embodiment, the outlet of the pump 612 may be coupled to a pipeline 616, or other form of conduit for conveying the output flow of the pump. In an exemplary embodiment, the inlet valve 600, seal assembly 608, motor 610, and pump 612 may be positioned within a wellbore casing 618 that traverses a subterranean formation 620. In an exemplary embodiment, the wellbore casing 618 is inclined and may, for example, be oriented in a direction that is horizontal.

As illustrated in FIG. 15, in an exemplary embodiment, during operation of the intake valve 600, when the inlet valve, seal assembly 608, motor 610, and pump 6512 are positioned within the wellbore casing 618, upper sealing elements, 606*a*, rest upon and fluidicly seal the corresponding openings 602*ba* of the corresponding radial passages 602*b* while lower sealing elements, 606*b*, are displaced out of engagement with the corresponding openings 602*ba* of the corresponding radial passages 602*b*. As a result, fluidic materials within the wellbore casing 618 may enter and pass through the lower radial passages 602*b* of the housing 602 of the intake valve 600. In an exemplary embodiment, the fluidic materials within the wellbore casing 618 may include both fluidic and gaseous materials. Typically, the gaseous materials that may be within the wellbore casing 618 will tend to remain in the upper portion of the wellbore casing. As a result, the operation of the intake valve 600 may prevent the intake of the gaseous materials into the pump 612. As will be recognized by persons having ordinary skill in the art, the efficiency of the pump 612 may be adversely affected if such gaseous materials are permitted into the intake of the pump.

It is understood that variations may be made in the above without departing from the scope of the invention. For example, the teachings of the exemplary embodiments may also be used to provide an intake valve for other types of pumps. While specific embodiments have been shown and described, modifications can be made by one skilled in the art without departing from the spirit or teaching of this invention. The embodiments as described are exemplary only and are not limiting. Many variations and modifications are possible and are within the scope of the invention. Accordingly, the scope of protection is not limited to the embodiments described, but is only limited by the claims that follow, the scope of which shall include all equivalents of the subject matter of the claims.

The invention claimed is:

1. An inlet apparatus for a submersible well pump, comprising:

a tubular housing for connection to an intake of the pump, the housing having an axis and defining a plurality of circumferentially spaced apart apertures; and a plurality of valve members operably coupled to the housing, each valve member adapted to control a flow of fluidic materials into at least one corresponding aperture;

wherein each valve member is adapted to prevent a flow of fluidic materials through a subset of the corresponding apertures.

2. An inlet apparatus for a submersible well pump, comprising:

a tubular housing for connection to an intake of the pump, the housing having an axis and defining a plurality of circumferentially spaced apart apertures; and a plurality of valve members operably coupled to the housing, each valve member adapted to control a flow of fluidic materials into at least one corresponding aperture;

wherein each valve member is adapted to cause a serpentine flow of fluidic materials through the corresponding apertures.

3. An inlet apparatus for a submersible well pump, comprising:

a tubular housing for connection to an intake of the pump, the housing having an axis and defining a plurality of circumferentially spaced apart apertures; and a plurality of valve members operably coupled to the housing, each valve member adapted to control a flow of fluidic materials into at least one corresponding aperture;

wherein each valve member is adapted to be displaced in a direction that is substantially parallel to the axis of the housing.

4. An inlet apparatus for a submersible well pump, comprising:

a tubular housing for connection to an intake of the pump, the housing having an axis and defining a plurality of circumferentially spaced apart apertures; and a plurality of valve members operably coupled to the housing, each valve member adapted to control a flow of fluidic materials into at least one corresponding aperture;

wherein the valve members are free to move with respect to the tubular housing; and wherein each valve member comprises a tubular member.

5. An inlet apparatus for a submersible well pump, comprising;

a tubular housing for connection to an intake of the pump, the housing having an axis and defining a plurality of circumferentially spaced apart apertures; and a plurality of valve members operably coupled to the housing, each valve member adapted to control a flow of fluidic materials into at least one corresponding aperture;

wherein the valve members are free to move with respect to the tubular housing; and wherein each valve member comprises a tapered tubular member.

6. An inlet apparatus for a submersible well pump, comprising:

a tubular housing for connection to an intake of the pump, the housing having an axis and defining a plurality of circumferentially spaced apart apertures; and a plurality of valve members operably coupled to the housing, each valve member adapted to control a flow of fluidic materials into at least one corresponding aperture;

wherein each valve member comprises a ball shaped member.

7. A method of operating an intake valve for a submersible pump, the valve comprising a plurality of valve elements for controlling the flow of materials into a plurality of inlet passages defined in the valve, comprising:

controlling a degree to which materials flow into the inlet passages of the valve by permitting a gravitational force to displace the valve elements relative to the valve.

8. The method of claim 7, wherein each valve element controls the degree to which materials flow into corresponding inlet passages.

9. The method of claim 8, wherein each valve element is adapted to prevent a flow of fluidic materials through a subset of the corresponding inlet passages.

10. The method of claim 8, wherein each valve element is adapted to cause a serpentine flow of fluidic materials through the corresponding inlet passages,

11. The method of claim 8, wherein each valve element is adapted to prevent a flow of fluidic materials through the corresponding inlet passages.

12. The method of claim 7, wherein each valve element is adapted to be displaced in a direction that is substantially orthogonal to the axis of the valve.

13. The method of claim 7, wherein each valve element is adapted to be displaced in a direction that is substantially parallel to the axis of the valve 14. An apparatus for pumping a well, comprising:

a pump; the pump having an intake section;

a tubular housing for connection to an intake of the pump, the housing having an axis and defining a plurality of circumferentially spaced apart apertures; and a plurality of valve members operably coupled to the housing, each valve member adapted to control a flow of fluidic materials into at least one corresponding aperture;

a sealing section coupled to the tubular housing;

a motor coupled to the sealing section; and a drive shaft coupled between the motor and the pump and passing through the tubular housing for transmitting torque from the motor to the pump;

wherein each valve member is adapted to prevent a flow of fluidic materials through a subset of the corresponding apertures.

15. An apparatus for pumping a well, comprising:

a pump; the pump having an intake section;

a tubular housing for connection to an intake of the pump, the housing having an axis and defining a plurality of circumferentially spaced apart apertures; and a plurality of valve members operably coupled to the housing, each valve member adapted to control a flow of fluidic materials into at least one corresponding aperture;

a sealing section coupled to the tubular housing;

a motor coupled to the sealing section; and a drive shaft coupled between the motor and the pump and passing through the tubular housing for transmitting torque from the motor to the pump;

wherein each valve member is adapted to cause a serpentine flow of fluidic materials through the corresponding apertures.

16. An apparatus for pumping a well, comprising:

a pump; the pump having an intake section;

a tubular housing for connection to an intake of the pump, the housing having an axis and defining a plurality of circumferentially spaced apart apertures; and a plurality of valve members operably coupled to the housing, each valve member adapted to control a flow of fluidic materials into at least one corresponding aperture;

a sealing section coupled to the tubular housing;

a motor coupled to the sealing section; and a drive shaft coupled between the motor and the pump and passing through the tubular housing for transmitting torque from the motor to the pump;

wherein each valve member is adapted to be displaced in a direction that is substantially parallel to the axis of the housing.

17. An apparatus for pumping a well, comprising:

a pump; the pump having an intake section;

a tubular housing for connection to an intake of the pump, the housing having an axis and defining a plurality of circumferentially spaced apart apertures; and a plurality of valve members operably coupled to the housing, each valve member adapted to control a flow of fluidic materials into at least one corresponding aperture;

a sealing section coupled to the tubular housing;

a motor coupled to the sealing section; and a drive shaft coupled between the motor and the pump and passing through the tubular housing for transmitting torque from the motor to the pump;

wherein the valve members are free to move with respect to the tubular housing; and wherein each valve member comprises a tubular member.

18. An apparatus for pumping a well, comprising:

a pump; the pump having an intake section;

a tubular housing for connection to an intake of the pump, the housing having an axis and defining a plurality of circumferentially spaced apart apertures; and a plurality of valve members operably coupled to the housing, each valve member adapted to control a flow of fluidic materials into at least one corresponding aperture;

a sealing section coupled to the tubular housing;

a motor coupled to the sealing section; and a drive shaft coupled between the motor and the pump and passing through the tubular housing for transmitting torque from the motor to the pump;

wherein the valve members are free to move with respect to the tubular housing; and wherein each valve member comprises a tapered tubular member.

19. An apparatus for pumping a well, comprising:

a pump; the pump having an intake section;

a tubular housing for connection to an intake of the pump, the housing having an axis and defining a plurality of circumferentially spaced apart apertures; and a plurality of valve members operably coupled to the housing, each valve member adapted to control a flow of fluidic materials into at least one corresponding aperture;

a sealing section coupled to the tubular housing;

a motor coupled to the sealing section; and a drive shaft coupled between the motor and the pump and passing through the tubular housing for transmitting torque from the motor to the pump;

wherein each valve member comprises a ball shaped member.

20. A method of operating a submersible pump comprising an inlet and an outlet, comprising:

positioning the pump within a wellbore casing that traverses a subterranean formation;

coupling a conduit to the outlet of the pump;

coupling a valve to the inlet of the pump that comprises a plurality of valve elements for controlling the flow of materials into a plurality of inlet passages defined in the valve;

coupling a motor to the pump; and controlling a degree to which materials flow into the inlet passages of the valve by permitting a gravitational force to displace the valve elements relative to the valve.

21. The method of claim 20, wherein each valve element controls the degree to which materials flow into corresponding inlet passages.

22. The method of claim 21, wherein each valve element is adapted to prevent a flow of fluidic materials through a subset of the corresponding inlet passages.

23. The method of claim 21, wherein each valve element is adapted to cause a serpentine flow of fluidic materials through the corresponding inlet passages.

24. The method of claim 21, wherein each valve element is adapted to prevent a flow of fluidic materials through the corresponding inlet passages.

25. The method of claim 20, wherein each valve element is adapted to be displaced in a direction that is substantially orthogonal to the axis of the valve.

26. The method of claim 20, wherein each valve element is adapted to be displaced in a direction that is substantially parallel to the axis of the valve.

* * * * *

UNITED STATES PATENT AND TRADEMARK OFFICE

CERTIFICATE OF CORRECTION

PATENT NO. : 7,980,314 B2
APPLICATION NO. : 12/254369
DATED : July 19, 2011
INVENTOR(S) : John J. Mack It is certified that error appears in the above-identified patent and that said Letters Patent is hereby corrected as shown below:

Column 1, line 19, delete “centrifugal” after the “.” and insert -- Centrifugal --

Signed and Sealed this
Eighth Day of November, 2011

David J. Kappos

David J. Kappos
*Director of the United States Patent and Trademark Office*